US009978225B1

(12) United States Patent
Maglica

(10) Patent No.: US 9,978,225 B1
(45) Date of Patent: May 22, 2018

(54) PORTABLE LAMP FLASHLIGHT

(71) Applicant: Mag Instrument, Inc., Ontario, CA (US)

(72) Inventor: Anthony Maglica, Ontario, CA (US)

(73) Assignee: MAG INSTRUMENT, INC., Ontario, CA (US)

( * ) Notice: Subject to any disclaimer, the term of this patent is extended or adjusted under 35 U.S.C. 154(b) by 0 days. days.

(21) Appl. No.: 15/599,763

(22) Filed: May 19, 2017

(51) Int. Cl.

| | |
|---|---|
| ***F21L 4/00*** | (2006.01) |
| ***G08B 5/36*** | (2006.01) |
| ***F21V 33/00*** | (2006.01) |
| *F21W 111/10* | (2006.01) |

(52) U.S. Cl.
CPC ..... *G08B 5/36* (2013.01); *F21L 4/00* (2013.01); *F21V 33/00* (2013.01); *F21W 2111/10* (2013.01)

(58) Field of Classification Search
CPC ..... F21L 2001/00; F21L 2003/00; F21L 4/00; F21L 4/022; F21L 4/025; F21L 4/04; F21L 4/045; F21L 15/00–15/14; F21L 25/00; G08B 5/36
USPC ..... 362/187, 196
See application file for complete search history.

(56) References Cited

U.S. PATENT DOCUMENTS

| | | | | |
|---|---|---|---|---|
| 3,383,675 | A | 5/1968 | Carrothers | |
| D263,170 | S | 2/1982 | Maglica | |
| 4,658,336 | A | 4/1987 | Maglica | |
| 5,165,781 | A | 11/1992 | Orak | |
| 6,286,973 | B1 | 9/2001 | Thrower | |
| 6,641,280 | B2 | 11/2003 | Hanson | |
| D548,862 | S | 8/2007 | Opolka | |
| D575,889 | S | 8/2008 | Shiu | |
| D614,333 | S | 4/2010 | Schnitzer | |
| D646,007 | S | 9/2011 | Tompkin | |
| D658,797 | S | 5/2012 | Bayat | |
| D672,894 | S | 12/2012 | Bayat | |
| D674,126 | S | 1/2013 | Mase | |
| D675,357 | S | 1/2013 | Shi | |
| D743,601 | S | 11/2015 | Maglica | |
| D755,429 | S | 5/2016 | Huang | |
| 2003/0099104 | A1* | 5/2003 | Hou | F21L 4/005 362/202 |
| 2006/0291198 | A1* | 12/2006 | Dalton | F21L 4/005 362/191 |

* cited by examiner

*Primary Examiner* — Elmito Breval
*Assistant Examiner* — Keith Delahoussaye
(74) *Attorney, Agent, or Firm* — Roy L. Anderson

(57) ABSTRACT

A flashlight capable of operating with its head removed in a candle mode is combined with a wand which has two inner zones to receive either the head of the flashlight or the barrel of the flashlight.

5 Claims, 5 Drawing Sheets

PORTABLE LAMP FLASHLIGHT

FIELD OF THE INVENTION

This application is in the field of flashlights and traffic wands.

BACKGROUND OF THE INVENTION

Mag Instrument, Inc. has sold over one hundred million flashlights that have a "candle mode" of operation in which the head of the flashlight can be removed and the barrel can be inserted into its base, as is described in U.S. Pat. No. 4,658,336, the disclosure of which is specifically incorporated herein by reference. While the Mini-Maglite® flashlight has a rotary switch, it is possible that the tail cap of a flashlight, such as the Mini-Maglite® flashlight, might be replaced with a tail cap switch and still be operable in a candle mode of operation in which the barrel is inserted into the head of the flashlight to give off light with the head removed, thus creating a lighting effect reminiscent of a candle. Also, while the original Mini-Maglite® flashlights used bi-pin bulbs, more recent flashlights utilizing an LED can also be operated in the candle mode of operation.

Traffic wands are known in the art and typically comprise a cone-like structure that fits over the head of a flashlight and then tapers down to a central opening. The cone-like structure is typically made of plastic, often yellow, orange or red, which becomes highly visible when the flashlight is turned on, while still allowing a beam of light to exit the wand through the central opening. Traffic wands are useful for traffic control and other activities.

The present invention combines a traffic wand with a flashlight operable in a candle mode of operation to create a new, unique structure, which is named a portable lamp flashlight.

SUMMARY OF THE INVENTION

The present invention is generally directed to a combination of a flashlight capable of operating with its head removed in a candle mode with a wand which has an inner bore with a first zone configured to receive and hold the head and a second zone configured to receive and hold the head end of the barrel when the head is removed from the flashlight. The second zone can be created by use of ribs that can function as stops to prevent the head from moving into the second zone along with additional stops that prevent a barrel from moving beyond the second zone into an internal core of the battery.

Accordingly, it is a primary object of the present invention to provide an improved lighting apparatus with a new portable flashlight lamp mode of operation.

This and further objects and advantages will be apparent to those skilled in the art in connection with the drawings and the detailed description of the invention set forth below.

BRIEF DESCRIPTION OF THE DRAWINGS

FIG. 1 illustrates a portable lamp flashlight in accordance with the present invention while

FIG. 3 is a cross section illustration of the wand shown in FIGS. 1 and 2 while

FIG. 5 is a cross section illustration of the wand from FIG. 3 fitted to the barrel of the flashlight from FIG. 1 while In FIG. 5, the flashlight is operating in a candle mode of operation and is inserted further into the wand of FIG. 3.

DETAILED DESCRIPTION OF THE INVENTION

Figure 1A:
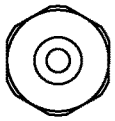
FIGS. 1A and 1B are, respectively, top and bottom plan views of the portable lamp flashlight of FIG. 1.
Figure 1:
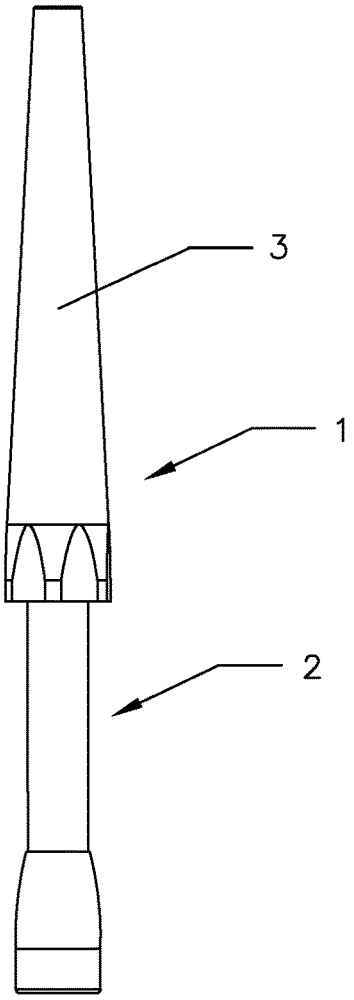
Figure 1B:
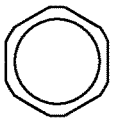
Figure 2:
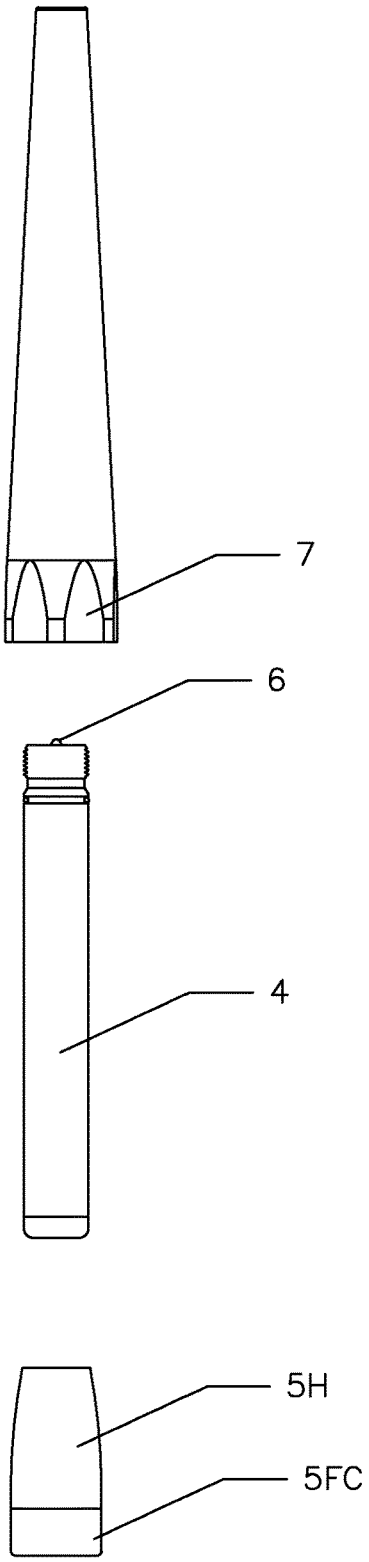
FIG. 2 illustrates the portable lamp flashlight of FIG. 1 separated into three components.
Figure 3A:
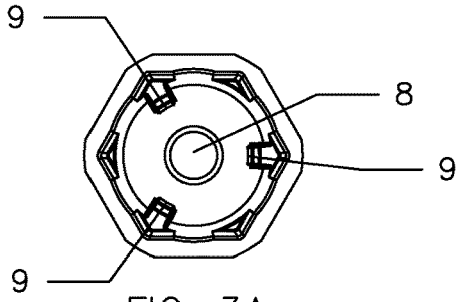
FIG. 3A is a top plan view of the wand of FIG. 3.
Figure 3:
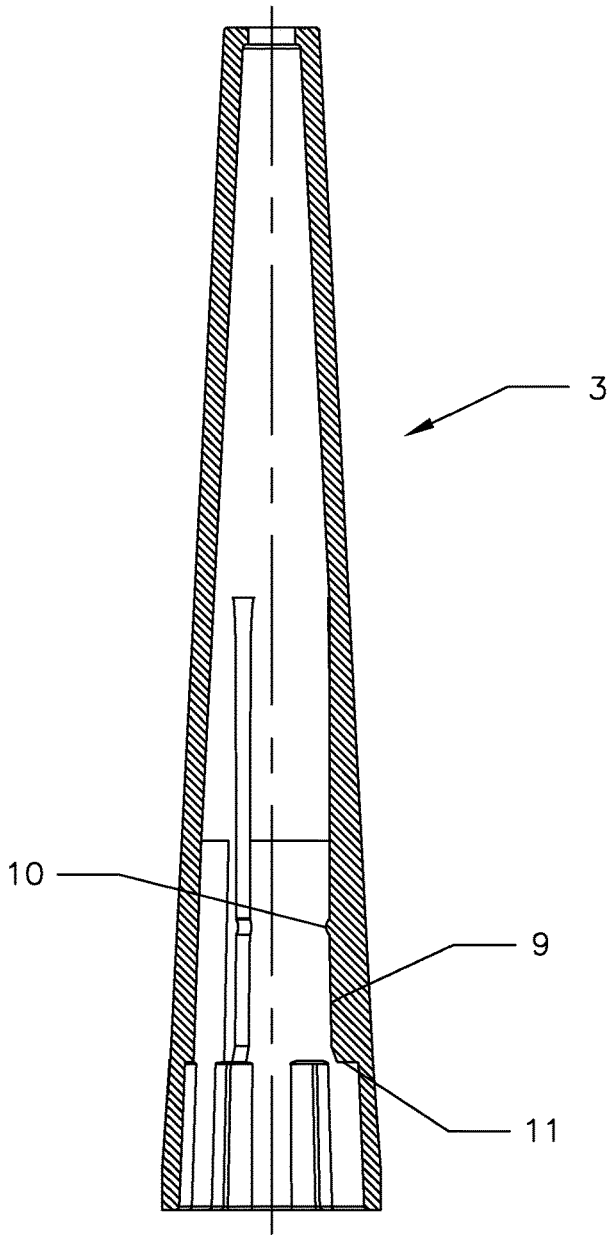

In the Figures and the following detailed description, numerals indicate various physical components, elements or assemblies, with like numerals referring to like features throughout both the drawings and the description. Although the Figures are described in greater detail below, the following is a glossary of elements identified in the Figures.

1 portable lamp flashlight
2 flashlight
3 wand
4 barrel of flashlight 2
5H head of flashlight 2
5FC face cap that screws onto 5H
5K knurling on 5H
6 light source
7 flat portion of wand 3
8 central opening in wand 3
9 rib formed in interior of wand 3
10 bump or secondary stop formed in interior of wand 3
11 stop of rib 9

Figure 4:
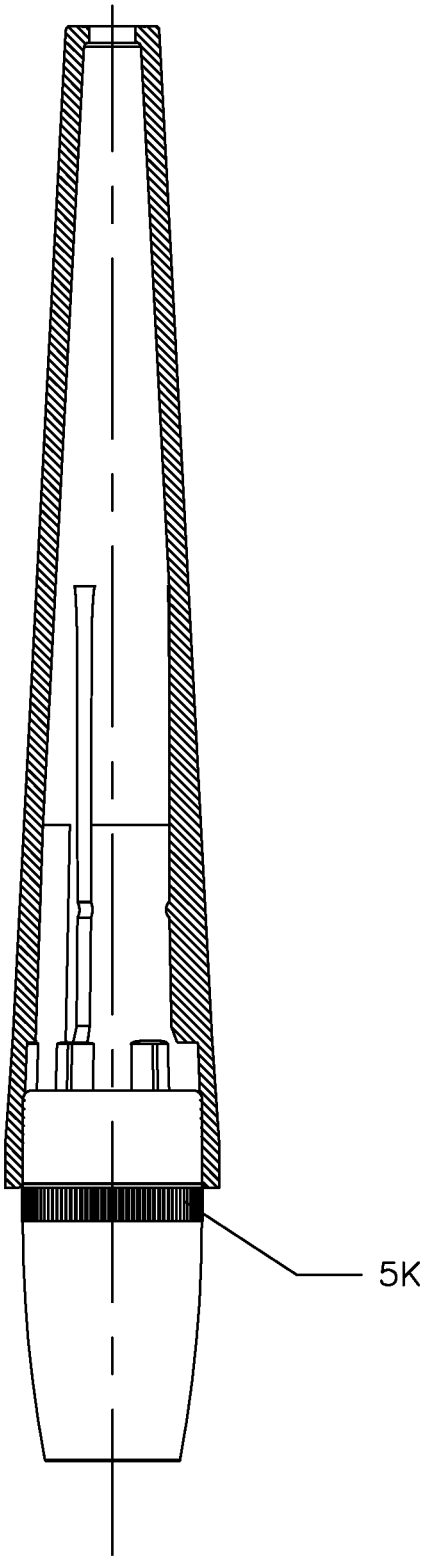
FIG. 4 is a cross section illustration of the wand from FIG. 3 fitted to the head of the flashlight from FIG. 1 with additional knurling shown on the head. In this illustration, the flashlight is not operating in a candle mode of operation.
Figure 5:
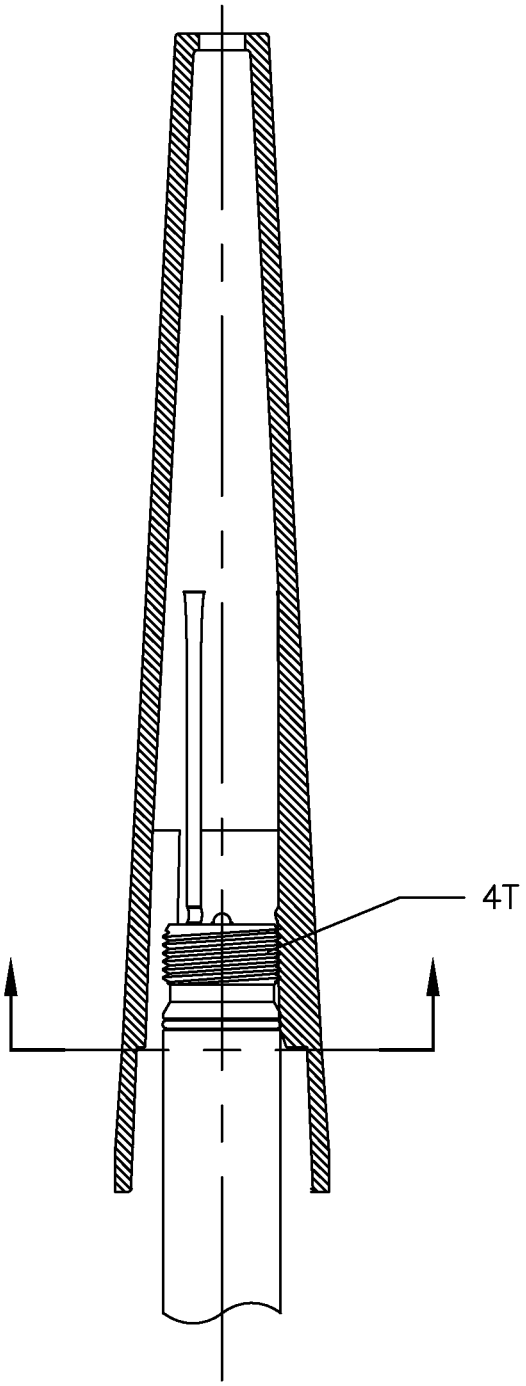
Figure 5A:
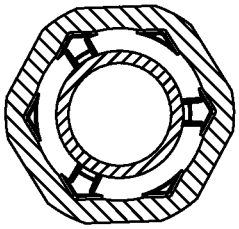
FIG. 5A is a cross section illustration of FIG. 5.

In accordance with the present invention, a wand 3 is provided which can be used with flashlight 2 in a normal mode of operation in which the head of the flashlight is held within the wand in a first zone (illustrated in FIG. 4) or in a candle mode of operation in which the barrel of the flashlight is held within the wand in a deeper second zone (illustrated in FIG. 5).

Use of wand 3 in the normal mode of operation is similar to what exists today in prior art, in that a head of flashlight 2 is inserted into a wand (the head of the flashlight typically has a face-cap that is part of, and removable from, the head). When flashlight 2 and wand 3 are configured together in this mode of operation, they are useful for traffic control and other uses in the same way that conventional flashlights and traffic wands can be used together.

As illustrated in FIG. 4, wand 3 is inserted over and receives face cap 5FC and, in an especially preferred embodiment, may be held by face cap 5FC before knurling 5K of head 5H is received within wand 3, and before face cap 5FC is stopped from moving further into wand 3 by stops 11 of ribs 9. The depth to which flashlight 2 is pushed into this first zone of wand 3 may depend upon the strength of a user, and the exact location to which flashlight 2 is inserted is not critical. The depth of this first zone, however, is limited by appearance of ribs 9 which are used for contact in the deeper second zone.

When flashlight 2 is operating in a candle mode of operation, as illustrated in FIG. 5, the head of flashlight 2 is removed and now barrel 4, which has a smaller diameter than the largest diameter of the head of flashlight 2 (which, in the embodiment illustrated, is the diameter of face cap 5FC), is inserted deeper into wand 3 into the deeper second zone where ribs 9 come into contact with the outer diameter of barrel 4 and, ultimately, in an especially preferred embodiment, further movement of barrel 4 within wand 3 is limited by bumps or secondary stops 10 formed on ribs 9.

Use of flashlight 2 in a candle mode of operation with wand 3 creates a portable lamp flashlight that can function like a lamp, in that it can be placed on a flat surface, especially if additional support is obtained by inserting barrel 4 into the head of the flashlight (although this mode of operation can also function without using the head as an additional base support as long as the tail cap is configured to allow such use). Because flashlight 2 does not have its head to focus light emanating from light source 6, such light spreads out and helps to light up wand 3, with wand 3 functioning in a manner similar to a shade in a lamp to prevent direct exposure of a viewer to the light source, while still allowing light to emanate from the shade and out through central opening 8. Also, the combination of the wand, the barrel and the head (when used as a base) creates a unique ornamental look, something more akin to a lamp than a flashlight. And, since the wand can be easily removed from the flashlight, and the head replaced on the flashlight, the flashlight can always be converted back to its original use and function as a flashlight.

Accordingly, the present invention provides four distinct modes of operation or use, in that the flashlight can operate in: 1) a normal flashlight mode; 2) a traffic wand mode; 3) a candle mode; or 4) a new lamp-like mode.

While the invention has been described herein with reference to certain preferred embodiments, those embodiments have been presented by way of example only, and not to limit the scope of the invention. For example, in an especially preferred embodiment of the present invention there are three ribs 9, each of which has a stop 11 and a bump or secondary stop 10, but other numbers of ribs are within the scope of the present invention, as are use of stops in locations other than associated with ribs. Additional embodiments will be obvious to those skilled in the art having the benefit of this detailed description.

Accordingly, still further changes and modifications in the actual concepts descried herein can readily be made without departing from the spirit and scope of the disclosed inventions as defined by the following claims.

What is claimed is:

1. A portable lamp flashlight assembly, comprising:

a flashlight, said flashlight comprising:

a barrel configured to receive and hold a light source, said barrel having a tail cap end opposite a head end; and a head configured to be removably attached to the head end of the barrel, said head receiving the tail cap end of the barrel; and a wand held by the head end of the barrel;

wherein the wand has an inner bore having a first zone configured to receive and hold the head and a second zone configured to receive and hold the head end of the barrel, wherein the inner bore in the first zone has a wider opening than in the second zone;

wherein the inner bore of the wand is configured with at least one stop to prevent the head from entering into the second zone when the flashlight in a normal mode of operation with the head attached to the head end of the barrel is inserted into the inner bore; and wherein the flashlight is configured to work in a candle mode when head is removed from the head end of the barrel.

2. The portable lamp flashlight assembly of claim 1, wherein the second zone of the inner bore is configured with three ribs and each rib has a first stop for preventing the head from entering the second zone.

3. The portable lamp flashlight assembly of claim 2, where each of the three ribs has a second stop for preventing the head end of the barrel from going further into the inner bore than the second zone.

4. A lighting apparatus, comprising:

a flashlight having a barrel and a head removably connected to a head end of the barrel, wherein the flashlight is configured to work in a normal mode in which light emanates from the head end from a light source and the flashlight is also configured to work in a candle mode in which the head is removed from the barrel and light emanates from the head end of the barrel; and a wand having an inner bore with a first zone configured to receive and hold the head and a second zone configured to receive and hold the head end of the barrel, wherein the inner bore in the first zone has a wider opening than in the second zone; and wherein the inner bore of the wand is configured with at least one stop to prevent the head from entering into the second zone when the flashlight in the normal mode is inserted into the inner bore.

5. The lighting apparatus of claim 4, wherein the head is configured to receive and hold the barrel opposite the head end in the candle mode.

* * * * *